United States Patent [19]

Allison

[11] 4,029,910

[45] June 14, 1977

[54] WIDE DISPERSION LOUDSPEAKER WITH FLEXING DIAPHRAGM

[75] Inventor: Roy F. Allison, Wayland, Mass.

[73] Assignee: Allison Acoustics, Inc., Natick, Mass.

[22] Filed: July 9, 1976

[21] Appl. No.: 704,068

Related U.S. Application Data

[63] Continuation-in-part of Ser. Nos. 465,856, May 1, 1974, abandoned, and Ser. No. 617,067, Sept. 26, 1975, abandoned.

[52] U.S. Cl. ..... 179/115.5 ME; 181/171; 181/173

[51] Int. Cl.[2] ..... H04R 7/12; H04R 7/18; H04R 9/06

[58] Field of Search ..... 179/115.5 R, 115.5 ME, 179/115.5 H, 116, 181 R; 181/157, 158, 159, 163, 164, 165, 171, 172, 173, 174

[56] References Cited

UNITED STATES PATENTS

| | | | |
|---|---|---|---|
| 2,423,037 | 6/1947 | Marquis et al. | 179/115.5 ME |
| 2,512,323 | 6/1950 | Gersch | 179/115.5 ME |
| 2,534,040 | 12/1950 | Lindley | 179/115.5 ME |
| 2,566,604 | 9/1951 | Eaves | 179/115.5 R |
| 2,630,189 | 3/1953 | Julie | 181/172 |
| 3,796,839 | 3/1974 | Torn | 179/115.5 R |

FOREIGN PATENTS OR APPLICATIONS

| | | | |
|---|---|---|---|
| 1,353,622 | 1/1964 | France | 179/115.5 ME |
| 886,467 | 7/1953 | Germany | 179/181 R |
| 764,823 | 1/1957 | United Kingdom | 179/115.5 ME |

*Primary Examiner*—George G. Stellar

[57] ABSTRACT

An audio loudspeaker comprising a diaphragm which is rotationally symmetrical about an axis, the diaphragm including a sound propagating surface extending between a larger circular edge and a smaller circular edge spaced apart therefrom along the axis in the direction of sound propagation. The voice coil former is secured to the diaphragm adjacent the smaller edge, the larger circular edge is fixed relative to the magnetic structure (e.g., to the mounting panel) and the included, initially acute, angle between a tangent to the sound propagating surface and the axis increases as the point of tangency moves from the smaller edge to the larger edge.

10 Claims, 2 Drawing Figures

WIDE DISPERSION LOUDSPEAKER WITH FLEXING DIAPHRAGM

Figure 1:
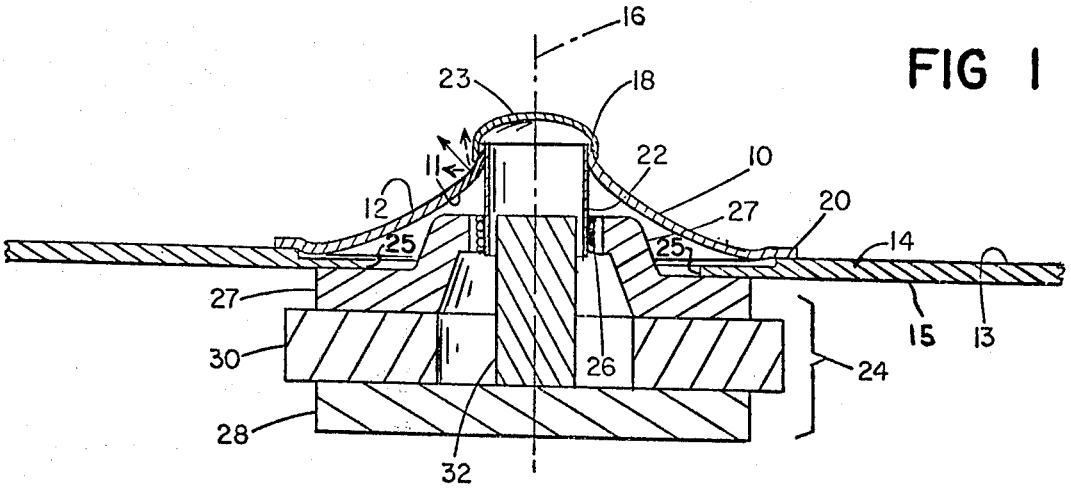

This application is a continuation-in-part of applications Ser. No. 465,856, filed May 1, 1974 and Ser. No. 617,067, filed Sept. 26, 1975 both abandoned.

This invention relates to direct-radiator loudspeakers.

Conventional direct-radiator loudspeakers which comprise a diaphragm, a voice coil former, and a magnetic circuit have included a sound propagating surface of the diaphragm which faces generally toward the direction of sound propagation (i.e., in the "forward" direction with respect to a speaker cabinet panel or other mounting surface and toward the listening space). Two basic types of these diaphragms have been common. The first of these is the conical form of diaphragm recessed in the mounting surface. The base of the cone (i.e., the diaphragm's larger end) is mounted flush with the front of the mounting surface, and the diaphragm projects rearwardly therefrom. The voice coil former is attached to the rear, smaller diameter end of the diaphragm cone and sound is radiated forwardly from the interior surface of the conical diaphragm, which is exposed to the listening space through the cone's open base. Over most of their intended operating range, such conical diaphragm speakers are, for a given cost of magnetic circuit materials, relatively efficient. However, the sound (even from a very shallow cone diaphragm) is channeled into a relatively small solid angle disposed around the axis of the cone and sound dispersion to off-axis regions of the listening space is relatively poor. This lack of uniformity of sound dispersion is especially marked at higher frequencies, for which the major diameter of the cone diaphragm is comparable to or greater than one half wave length.

The second type of conventional diaphragm approximates a section of a hollow sphere (e.g., a hemisphere). Such spherical dome-shape diaphragms generally project forward toward the listening space and provide for a more uniform dispersion of sound, especially at higher frequencies, over a larger solid angle than is obtainable from conventional cone-type loudspeakers. However, the voice coil former of a dome-shape diaphragm speaker is attached to the outer edge of the diaphragm and accordingly is much larger, and thus more expensive, than the voice coil former required for a cone-type diaphragm speaker of equivalent size. Over most of its operating range the spherical dome diaphragm speaker, for a given cost of magnetic circuit materials, is also inherently less efficient than the conical form type. That is, for a given electrical power input, a dome-type speaker produces less acoustical power output than does the cone-type speaker.

In view of the foregoing, it is a principal object of the present invention to provide a loudspeaker which achieves a uniformity of sound dispersion equal or superior to that of dome-type loudspeakers, while retaining the cost and efficiency advantages of the cone-type loudspeakers.

To achieve these and other objects as shall further appear herein, the invention provides improvements in audio speaker systems of the type which include a mounting panel (e.g., a speaker cabinet panel) and a loudspeaker which comprises a diaphragm rotationally symmetrical about an axis generally perpendicular to a front facing surface of the panel and including a sound propagating surface for propagating sound into the listening space forward of the front facing surface, a voice coil former secured to the diaphragm, a voice coil, and magnetic structure for driving the voice coil. The improvements feature the diaphragm's sound propagating surface extending between a larger circular edge and a smaller circular edge spaced apart from the larger edge along the axis of the diaphragm in the direction towards the listening space, the voice coil former secured to the smaller edge, the longer circular edge being fixed (e.g., to the mounting panel) and the sound propagating surface being curved such that the included, initially acute, angle between a tangent to the surface and the axis continuously increases as the point of tangency moves from the smaller edge to the larger edge. When the voice coil of such a speaker vibrates parallel to the axis, the resulting vibration of the sound propagating surface has in-phase components of velocity both parallel and perpendicular to the axis and projects sound into a full $2\pi$ steradian space. Preferred embodiments feature diaphragms of uniform thickness mounted so that the entire sound propagating surface is forward of the front surface of the mounting panel and the magnetic structure is disposed within the volume bounded by the diaphragm so that the diaphragm itself defines the size of the loudspeaker, and sealing the space to the rear of the diaphragm.

Other objects, features, and advantages of the invention will appear from the following description of particular preferred embodiments which are illustrated in the accompanying drawing. In the drawing, FIGS. 1 and 2 are somewhat schematic sectional views of alternative embodiments of audio systems constructed according to the present invention.

Figure 2:
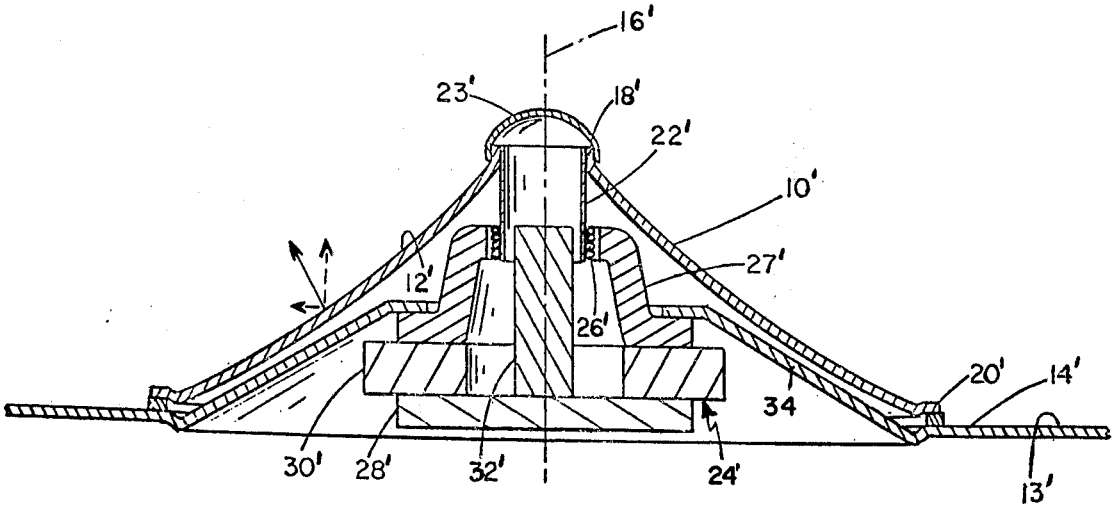

Referring to FIG. 1 of the drawing, the loudspeaker there shown includes a diaphragm 10 of uniform thickness having an exterior sound-propagating surface 12 generally facing the direction of sound-propagation (i.e., the $2\pi$ steradian solid angle defined by front facing surface 13 of mounting panel 14). The diaphragm 10 is rotationally symmetrical about its axis 16. The diaphragm extends between a smaller, circular forward edge 18 and a larger circular rear edge 20, each edge being centered on axis 16 and the larger edge 20 being secured to front facing panel surface 13. The sound propagating surface 12 defined by diaphragm 10 is smoothly curved inwardly toward the axis 16; that is, a tangent to surface 12 makes an angle with axis 16 which smoothly increases as the point of tangency moves from the smaller forward edge 18 of diaphragm 10 to the larger rear edge 20.

A voice coil former 22, coaxial with the diaphragm 10, is secured to the diaphragm adjacent the forward edge 18; as is central (high frequency) radiating cap 23. Magnetic structure 24, defining a magnetic circuit, is disposed for driving the voice coil former 22 through the voice coil 26. The structure 24 comprises top plate 27, bottom plate 28, magnet 30, and interior pole piece 32. The inner edge of plate 27 is offset along axis 16 and the pole piece 32 is unconventionally elongated so that a desirably short voice coil former is possible. The diameters of voice coil former 22 and of pole piece 32 are both no greater than that of the smaller forward edge 18 of diaphragm 10. As shown, the outer surface of cap 23 has a curvature opposite to that of diaphragm sound propagating surface 12.

As shown, magnetic structure 24 is mounted on the rear surface 15 of panel 14, and top plate 27 and pole 32 project through opening 25 in panel 14 into the space within the conical "tent" of diaphragm 10 and forward of mounting panel 14. The magnetic structure forms a solid barrier sealing the space behind diaphragm 10 and effectively preventing sound propagation from the rear of the loudspeaker.

In the loudspeaker system manufactured and sold by Allison Acoustics, Inc. of Natick, Mass., the assignee of the present application, under the trademark "Allison: One" speakers having the FIG. 1 design discussed above (slightly modified so that the plate 27 does not project through opening 25, thereby permitting the overall diameter of the diaphragm to be reduced to 1 in.) are used as tweeters and reproduce sound at frequencies above 3750 Hertz.

FIG. 2 illustrates a second speaker embodying the present invention. Many portions of the speaker of FIG. 2 are substantially the same as corresponding portions of the speaker of FIG. 1 and are identified by the same reference mumeral, with a differentiating prime (′) added thereto.

As is apparent from the drawing, the diaphragm 10′ of the speaker of FIG. 2 is considerably larger, relative to the speaker's magnetic structure 24′, than is the case in the speaker of FIG. 1. The entirety of the magnetic structure 24′ thus can be positioned within the volume defined by the diaphragm 10′, on the front side of the plane of mounting panel 14′. The space behind diaphragm 10′ is sealed by magnetic structure 24′ and the annular portion 34 of mounting panel 14′ that extends between plate 27′ and diaphragm edge 20′. This sealed configuration, as previously indicated, prevents interference from the low frequency reproducer of the system. Additionally, this arrangement provides for a compact, neat loudspeaker and permits the further shortening of the voice coil former 22 for a given size diaphragm 10′.

As is evident from the drawings, the sound propagating surfaces 12, 12′ of the loudspeakers shown in FIGS. 1 and 2 are positioned forward of the planes of the speaker's respective mounting panels 14, 14′; there is no acoustically opaque structure on the side of the sound propagating surface facing the listening area and the voice coil former 22, 22′ are substantially equal in diameter to and secured to the smaller edges 18, 18′ of the respective diaphragms 10, 10′. Further, as will be evident to those skilled in the art, the smooth, inwardly curved configuration of sound propagating surfaces 12, 12′ results in each element of the surfaces 12, 12′ having components of velocity in its vibratory motion which are both parallel and perpendicular to their respective axes 16, 16′ with these components being in phase. Each sound propagating surface 12, 12′, thus effectively projects sound directly into the full $2\pi$ steradian space in front of the speaker's mounting panel, and the speaker of which it is a part requires a voice coil former of relatively smaller size and achieves the benefits of both the conventional cone and dome diaphragms speakers of the prior art.

While particular preferred embodiments of the present invention have been illustrated in the accompanying drawing and described herein, other embodiments are within the scope of the invention and the following claims.

What is claimed is:

1. In an audio speaker system comprising a mounting panel having a front surface facing towards a listening space and a loudspeaker secured to said panel for projecting sound directly into said listening space forward of said front surface, said loudspeaker comprising a diaphragm rotationally symmetrical about an axis generally perpendicular to said front surface, a voice coil former secured to said diaphragm, a voice coil secured to said voice coil former, and magnetic structure for driving said voice coil, that improvement wherein:

said diaphragm defines a sound propagating surface extending from a larger circular edge of said diaphragm to a smaller circular edge of said diaphragm spaced apart from said larger circular edge along said axis in the direction towards said listening space;

said voice coil former is secured to said diaphragm adjacent said smaller edge;

said sound propagating surface faces towards said listening space and is curved such that the included, initially acute, angle between a tangent to said sound propagating surface and said axis continuously increases as the point of tangency moves from said smaller edge to said larger edge; and said loudspeaker includes means causing vibration of said voice coil parallel to said axis to produce vibration of said sound propagating surface having in phase components of velocity both parallel and perpendicular to said axis, said means including fixing said larger edge relative to said mounting panel, whereby said loudspeaker projects sound into the full $2\pi$ steradian solid angle on the side of said front surface towards said listening space.

2. The system of claim 1 wherein said diaphragm is of uniform thickness.

3. The system of claim 1 wherein said system includes means effectively preventing propagation of high frequency sound into said listening space from the surface of said diaphragm opposite said sound propagating surface.

4. The system of claim 3 wherein said means includes sealing structure overlying said surface of said diaphragm opposite said sound propagating surface, engaging said mounting panel, and sealing a volume within the bounds of said diaphragm.

5. The system of claim 1 wherein said magnetic structure is disposed within the volume bounded by said diaphragm.

6. The system of claim 1 further including a high frequency radiating cap secured to said diaphragm adjacent said smaller edge.

7. The system of claim 6 wherein said cap has an outer surface of a curvature opposite that of said sound propagating surface.

8. In an audio loudspeaker comprising a diaphragm rotationally symmetrical about an axis, a voice coil former secured to said diaphragm, a voice coil secured to said voice coil former, and magnetic structure for driving said voice coil, that improvement wherein:

said diaphragm defines a sound propagating surface extending from a larger circular edge of said diaphragm to a smaller circular edge of said diaphragm spaced apart therefrom along said axis and facing generally outwardly from said axis;

said voice coil former is secured to said diaphragm adjacent said smaller edge and extends from said smaller edge and extends from said smaller edge towards said larger edge generally coaxially of said axis;

said sound propagating surface is curved such that the included, initially acute, angle between a tangent to said sound propagating surface and said axis increases as the point of tangency moves from said smaller edge to said larger edge;

sealing means overlying the surface of said diaphragm opposite said sound propagating surface and secured to said larger circular edge seals a volume within the bounds of said diaphragm and prevents propagation of sound from said surface of said diaphragm opposite said sound propagating surface; and, said loudspeaker includes means causing vibration of said voice coil parallel to said axis to produce vibration of said sound propagating surface having in phase components both parallel and perpendicular to said axis, said means including fixing said larger edge of said sound projecting surface relative to said magnetic structure, whereby said loudspeaker projects sound into a full 2 $\pi$ steradian solid angle.

9. The speaker of claim 8 wherein said diaphragm is of uniform thickness.

10. The speaker of claim 8 further including a high frequency radiating cap of curvature opposite to that of said sound propagating surface secured to said diaphragm adjacent said smaller edge.

* * * * *

Disclaimer and Dedication 4,029,910.—*Roy F. Allison*, Wayland, Mass. WIDE DISPERSION LOUDSPEAKER WITH FLEXING DIAPHRAGM. Patent dated June 14, 1977. Disclaimer and Dedication filed Jan. 16, 1978, by the assignee, *Allison Acoustics Inc.*

Hereby disclaims and dedicates to the Public all claims of said patent.

[*Official Gazette March 28, 1978.*]